US011425991B2

(12) United States Patent
Stoerkel et al.

(10) Patent No.: US 11,425,991 B2
(45) **Date of Patent: *Aug. 30, 2022**

(54) HEAD FOR AN ORAL CARE IMPLEMENT

(71) Applicant: The Procter & Gamble Company, Cincinnati, OH (US)

(72) Inventors: Ulrich Stoerkel, Bad Nauheim (DE); Simone Bertrand, Frankfurt am Main (DE); Marlis Huebner, Bad Soden (DE); Andreas Birk, Kronberq/Taunus (DE); Franziska Schmid, Frankfurt am Main (DE); Alexander Hilscher, Oberursel (DE); Heidrun Schmelcher, Oberursel (DE); Jochen Ganninger, Eschborn (DE); Jochen Kawerau, Kronberq/Taunus (DE); Uwe Jungnickel, Königstein/Taunus (DE); Benedikt Heil, Friedberg (DE); Christian Mandl, Bad Soden (DE); Eva Kaiser, Kelkheim (DE); Kathi Ballmaier, Wehrheim (DE); Christine Hielscher, Munich (DE); Britta Stockinger, Frankfurt am Main (DE)

(73) Assignee: The Procter & Gamble Company, Cincinnati, OH (US)

( * ) Notice: Subject to any disclaimer, the term of this patent is extended or adjusted under 35 U.S.C. 154(b) by 602 days.

This patent is subject to a terminal disclaimer.

(21) Appl. No.: 14/645,245

(22) Filed: Mar. 11, 2015

(65) Prior Publication Data

US 2015/0257520 A1 Sep. 17, 2015

(30) Foreign Application Priority Data

Mar. 11, 2014 (EP) ..... 14158836

(51) Int. Cl.

| | |
|---|---|
| ***A46B 9/04*** | (2006.01) |
| ***A46B 9/02*** | (2006.01) |
| ***A46D 1/00*** | (2006.01) |

(52) U.S. Cl.

CPC ..... *A46B 9/04* (2013.01); *A46B 9/028* (2013.01); *A46D 1/006* (2013.01); *A46D 1/02* (2013.01);

(Continued)

(58) Field of Classification Search

CPC ... A46B 9/04; A46B 9/028; A46B 2200/1066; A46D 1/006; A46D 1/02; A46D 1/0238; A46D 1/04; A46D 1/023; A46D 1/026

(Continued)

(56) References Cited

U.S. PATENT DOCUMENTS

| | | | |
|---|---|---|---|
| 1,773,969 | A | 8/1930 | Camille |
| 2,317,485 | A | 4/1943 | Rider |

(Continued)

FOREIGN PATENT DOCUMENTS

| | | | |
|---|---|---|---|
| CN | 87203469 | U | 3/1988 |
| CN | 2101402 | U | 4/1992 |

(Continued)

OTHER PUBLICATIONS

All Office Actions; U.S. Appl. No. 15/729,261, filed Oct. 10, 2017.

(Continued)

*Primary Examiner* — Anne M Kozak
*Assistant Examiner* — Makena S Markman
(74) *Attorney, Agent, or Firm* — Vladimir Vitenberg

(57) ABSTRACT

A head for an oral care implement has a mounting surface and at least one tuft mounted thereon. The tuft has a longitudinal axis and a cross-sectional area extending in a plane perpendicular to the longitudinal axis. The tuft comprises a plurality of substantially cylindrical filaments. Each (Continued)

filament has a longitudinal axis and a cross-sectional area extending in a plane that is perpendicular to the longitudinal axis. The cross-sectional area of an individual filament has a substantially non-circular shape. The plurality of filaments is arranged such that the cross-sectional area of the tuft has a scaled-up shape of the individual filament's cross-sectional area.

12 Claims, 6 Drawing Sheets

(52) U.S. Cl.
CPC .... *A46D 1/0238* (2013.01); *A46B 2200/1066* (2013.01); *A46D 1/023* (2013.01)

(58) Field of Classification Search
USPC ..... 15/167.1, 207.2
See application file for complete search history.

(56) References Cited

U.S. PATENT DOCUMENTS 2,637,893 A 5/1953 Shaw
2,876,477 A * 3/1959 Stewart ..... A46B 9/04 15/159.1
3,032,230 A 5/1962 Gerber
3,072,944 A 1/1963 Clayton
3,214,777 A 11/1965 Kutik
3,238,553 A 3/1966 Bailey et al.
3,344,457 A 10/1967 Jacques
3,613,143 A 10/1971 Muhler et al.
3,689,118 A * 9/1972 Charvat ..... A46D 1/023 300/21
3,691,585 A * 9/1972 Flom ..... A46B 1/00 15/104.94
4,167,794 A 9/1979 Pomeroy
4,802,255 A 2/1989 Breuer et al.
D301,397 S 6/1989 Lacher
4,958,402 A 9/1990 Weihrauch
5,313,909 A 5/1994 Tseng et al.
5,396,678 A 3/1995 Bredall et al.
5,701,629 A 12/1997 Obrien
5,806,127 A 9/1998 Samoil et al.
5,906,834 A 5/1999 Tseng
5,933,908 A 8/1999 Obrien
5,985,450 A 11/1999 Keller
6,018,840 A 2/2000 Guay et al.
6,065,176 A 5/2000 Watanabe
6,086,373 A 7/2000 Schiff et al.
6,094,769 A 8/2000 Driesen
6,138,314 A * 10/2000 Schiff ..... A46D 1/00 15/167.1
6,161,243 A 12/2000 Weihrauch
6,276,021 B1 8/2001 Hohlbein
6,280,113 B1 8/2001 Gueret
6,327,736 B1 12/2001 Schaefer
6,352,772 B1 3/2002 Keller
6,390,708 B1 5/2002 Gueret
6,493,897 B2 12/2002 Culbreth
6,669,389 B2 12/2003 Gueret
RE38,646 E 11/2004 Gueret
6,810,550 B1 11/2004 Wuelknitz et al.
6,871,373 B2 3/2005 Driesen
6,886,207 B1 5/2005 Solanki
7,014,800 B2 3/2006 Weihrauch
7,644,466 B2 1/2010 Weihrauch
8,075,216 B2 12/2011 Gatzmeyer et al.
8,185,993 B2 5/2012 Fischer et al.
8,297,710 B2 * 10/2012 Sakurai ..... A46D 1/00 300/21
8,453,288 B2 6/2013 Driesen
8,726,448 B2 5/2014 Kato et al.
9,445,660 B2 9/2016 Mintel
9,538,836 B2 * 1/2017 Mintel ..... A46B 9/04
9,572,417 B2 2/2017 Hess
10,004,322 B2 6/2018 Jungnickel
10,098,447 B2 * 10/2018 Newman ..... A46B 9/06
10,251,470 B1 4/2019 Alinski et al.
10,869,545 B2 12/2020 Mark et al.
2002/0164192 A1 11/2002 Gueret
2003/0044604 A1 3/2003 Weihrauch
2003/0088935 A1 5/2003 Favagrossa
2005/0160546 A1 * 7/2005 Weihrauch ..... A46B 15/001 15/207.2
2007/0289078 A1 12/2007 Driesen
2008/0181716 A1 7/2008 Gatzmeyer et al.
2008/0245385 A1 10/2008 Schrepf
2009/0013488 A1 1/2009 Sakurai et al.
2009/0142125 A1 6/2009 Henrikson
2009/0007357 A1 8/2009 Meadows et al.
2009/0255077 A1 10/2009 Mori et al.
2010/0306944 A1 12/2010 Herzog
2012/0246857 A1 * 10/2012 Kato ..... A46D 1/0207 15/167.1
2012/0301210 A1 11/2012 Sturgis
2012/0324668 A1 12/2012 Stofko
2013/0291326 A1 * 11/2013 Mintel ..... A46B 9/04 15/167.1
2013/0318732 A1 * 12/2013 Mintel ..... A46D 1/0276 15/167.1
2014/0359956 A1 12/2014 Jungnickel et al.
2015/0150367 A1 6/2015 Moskovich
2015/0257252 A1 9/2015 Kato
2015/0257520 A1 9/2015 Storkel et al.
2015/0257525 A1 * 9/2015 Kang ..... A46D 1/0207 15/167.1
2015/0359326 A1 12/2015 Chan et al.
2015/0361590 A1 12/2015 Chan et al.
2016/0015163 A1 1/2016 Newman et al.
2019/0000223 A1 1/2019 Alinski
2019/0014898 A1 1/2019 Newman
2019/0104834 A1 4/2019 Alinski
2019/0104835 A1 4/2019 Alinski
2019/0104839 A1 4/2019 Mark
2019/0104840 A1 4/2019 Mark
2019/0104841 A1 4/2019 Alinski
2019/0216212 A1 * 7/2019 Alinski ..... A46B 5/0095

FOREIGN PATENT DOCUMENTS

CN 200998006 Y 1/2008
CN 201256715 Y 6/2009
CN 201409607 Y 2/2010
CN 202666559 U 1/2013
CN 202941618 U 5/2013
CN 203467916 U 3/2014
DE 102006035156 A1 1/2008
EP 0663162 7/1995
JP H06217830 A 8/1994
JP H06233709 A 8/1994
JP H1175940 A 3/1999
JP 2000300345 A 10/2000
JP 2001169829 A 6/2001
JP 2002010831 A 1/2002
JP 2004202021 A 7/2004
JP 2005185399 A 7/2005
JP 2005253713 A 9/2005
JP 2006149419 A 6/2006
JP 2006255068 A 9/2006
JP 2007068954 A 3/2007
JP 2007185464 A 7/2007
JP 2007229317 A 9/2007
JP 2007283443 A 11/2007
JP 2007283444 A 11/2007
JP 2008023205 A 2/2008
JP 2008212510 A 9/2008
JP 2009148507 A 7/2009
JP 2009219520 A 10/2009
JP 2011030891 A 2/2011
JP 2012030037 A 2/2012
JP 2012106308 A 6/2012

(56) References Cited

FOREIGN PATENT DOCUMENTS

| | | | |
|---|---|---|---|
| JP | 3186567 | U | 10/2013 |
| JP | 2015006227 | A | 1/2015 |
| JP | 5779413 | B2 | 7/2015 |
| JP | 2015123245 | A | 7/2015 |
| KR | 200183557 | Y1 | 5/2000 |
| KR | 100503216 | B1 | 7/2005 |
| KR | 200427125 | Y1 | 9/2006 |
| KR | 20080011846 | A | 2/2008 |
| WO | 9709907 | A1 | 3/1997 |
| WO | 0001276 | A1 | 1/2000 |
| WO | WO200228222 | | 4/2002 |
| WO | WO 2012/096700 | A1 | 7/2012 |
| WO | WO 2012/096701 | A1 | 7/2012 |
| WO | WO2012096700 | A1 | 7/2012 |
| WO | WO2012096701 | A1 | 7/2012 |
| WO | 2014197293 | A1 | 12/2014 |

OTHER PUBLICATIONS

All Office Actions; U.S. Appl. No. 15/729,359, filed Oct. 10, 2017.
All Office Actions; U.S. Appl. No. 15/729,399, filed Oct. 10, 2017.
All Office Actions; U.S. Appl. No. 15/729,007, filed Oct. 10, 2017.
All Office Actions; U.S. Appl. No. 15/729,322, filed Oct. 10, 2017.
All Office Actions; U.S. Appl. No. 15/729,075, filed Oct. 10, 2017.
All Office Actions; U.S. Appl. No. 16/361,178, filed Mar. 21, 2019.
All Office Actions; U.S. Appl. No. 15/729,143, filed Oct. 10, 2017.
Extended EP Search Report and Written Opinion for 14158836.8; dated Jul. 22, 2014; 7 pages.
PCT Search Report with Written Opinion, dated Jun. 10, 2015, 10 pages.
PCT Search Report with Written Opinion, dated Jan. 17, 2017, 6 pages.

* cited by examiner

HEAD FOR AN ORAL CARE IMPLEMENT

FIELD OF THE INVENTION

The present disclosure is concerned with a head for an oral care implement and in particular with such a head comprising at least one tuft of filaments extending from a mounting surface of the head. Each filament of said tuft has a non-circular cross-sectional area which is perpendicular to a longitudinal extension of the filament.

BACKGROUND OF THE INVENTION

Tufts composed of a plurality of filaments for oral care implements, like manual and powered toothbrushes are well known in the art. Generally, the tufts are attached to a mounting surface of a head intended for insertion into a user's oral cavity. A grip handle is usually attached to the head, which handle is held by the user during brushing. The head is either permanently connected or repeatedly attachable to and detachable from the handle.

It is known that filaments often have an outer lateral surface with a substantially circular cylindrical shape. In general, the tips or free ends of the filaments are end-rounded to avoid that the gums get injured by sharp edges during brushing. Although the filament's tips are end-rounded, the person skilled in the art would still consider this type of filaments as substantially cylindrical in shape. The filaments are normally arranged in a manner that the tuft has an outer lateral surface with either a substantially circular cylindrical shape or a substantially rectangular cylindrical shape.

While toothbrushes comprising these types of tufts clean the outer buccal face of teeth adequately, they are generally not as well suited to provide adequate removal of plaque and debris from the gingival margin, interproximal areas, lingual surfaces and other hard to reach areas of the mouth.

Tufts composed of two different types of filaments, so called tuft-in-tufts, are also known in the art. In general, each type of filament is arranged in a group, wherein an inner group is substantially coaxially enclosed by an outer group to form the tuft. For example, a toothbrush head is known having a bristle surface from which tufts comprising plural filaments extend in a filament direction. Each tuft comprises shorter filaments having a cross section which does not taper from their lower end towards their upper end and greater/longer filaments which taper from their lower end towards their upper end. The longer filaments are surrounded by the shorter filaments.

However, it is known in the art that tapered filaments tend to flex away easily, i.e. tapered filaments normally show a relatively low bending stiffness which may result in reduced ability to penetrate into interdental spaces. In addition, tapered filaments may have a relatively short lifetime as they wear away quickly.

It is an object of the present disclosure to provide a head for an oral care implement which overcomes these drawbacks. It is also an object of the present disclosure to provide an oral care implement comprising such head.

SUMMARY OF THE INVENTION

In accordance with one aspect, a head for an oral care implement is provided that comprises a mounting surface and at least one tuft mounted on the mounting surface. The tuft has a longitudinal axis and a cross-sectional area extending in a plane that is perpendicular to the longitudinal axis.

The tuft comprises a plurality of substantially cylindrical filaments. Each filament has a longitudinal axis and a cross-sectional area extending in a plane that is perpendicular to the longitudinal axis. The cross-sectional area of each filament has a substantially non-circular shape. The plurality of filaments is arranged in a manner that the cross-sectional area of the tuft has a scaled up shape with respect to the shape of the cross-sectional area of each filament.

In accordance with one aspect, an oral care implement is provided that comprises such head.

BRIEF DESCRIPTION OF THE DRAWINGS

The invention is described in more detail below with reference to various embodiments and figures, wherein.

DETAILED DESCRIPTION OF THE INVENTION

Figure 1:
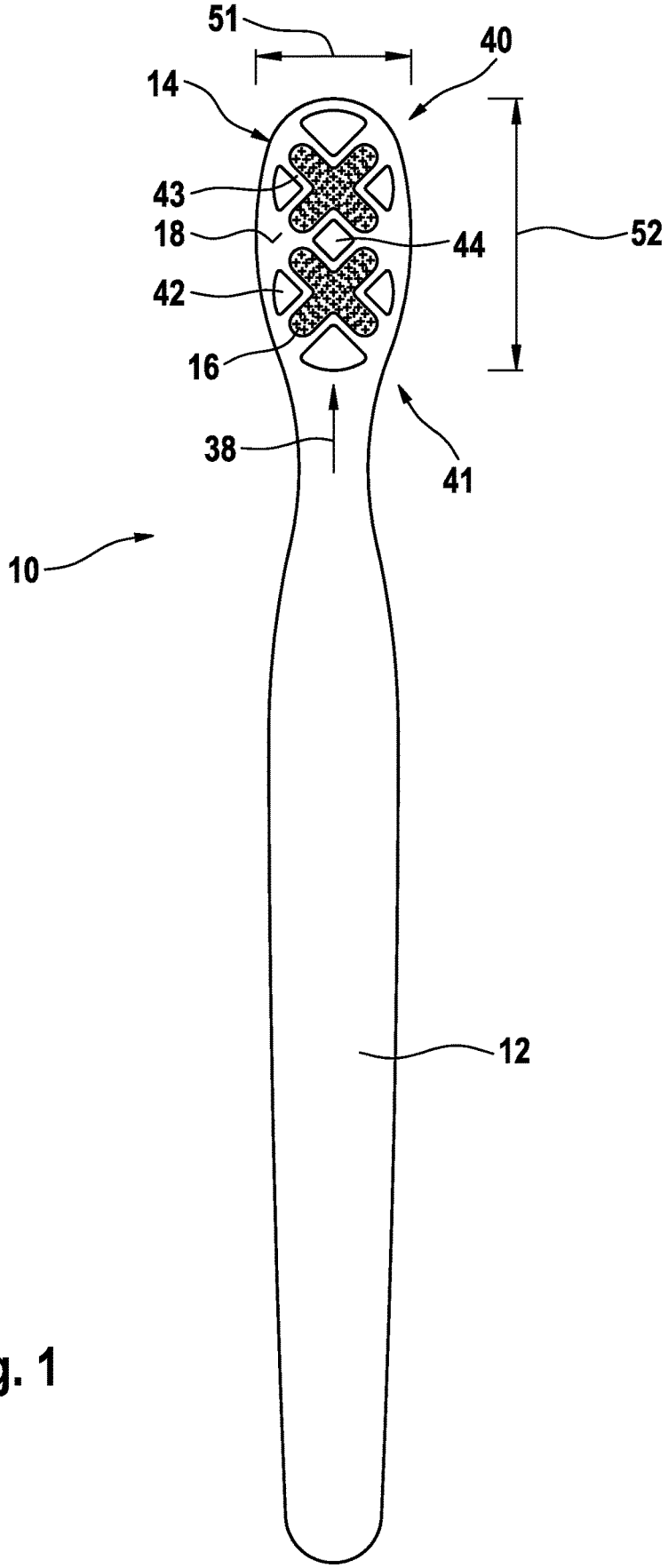
FIG. 1 shows a schematic top-down view of a first example embodiment of an oral care implement comprising a first example embodiment of a head.

A head for an oral care implement in accordance with the present disclosure comprises at least one tuft which comprises a plurality of filaments. The tuft is mounted on a mounting surface of the head.

Each filament of the tuft has a longitudinal axis which may be defined by the main extension of the filament. In the following, the extension of the filament along its longitudinal axis may be referred to as the "longitudinal extension of the filament". Each filament has a cross-sectional area which extends in a plane that is perpendicular to the longitudinal axis. The shape of said cross-sectional area is substantially non-circular. In the context of this disclosure the term "substantially non-circular shape of a cross-sectional area" may be defined by the following: The cross-sectional area has a centroid from which straight lines extend to any point on the outer circumference of the cross-sectional area. At least two of said straight lines have substantially different lengths. In other words, the radius measured from the centroid to any point on the circumference of the cross-sectional area is substantially not constant.

The filaments are substantially cylindrical filaments, i.e. each filament has a substantially cylindrical outer lateral surface. In other words, the shape and size of the cross-sectional area of each filament along its longitudinal axis may not vary substantially, i.e. the shape and size of the cross-sectional area may be substantially constant over the longitudinal extension of the filament. In the context of this disclosure the term "outer lateral surface of a filament/tuft" means any outer face or surface of the filament/tuft on its sides. This type of filaments may provide increased bending stiffness compared to tapered filaments. A higher bending stiffness may facilitate the filaments to penetrate into inter-dental gaps/spaces. Further, cylindrical filaments are generally slowly worn away which may provide longer lifetime of the filaments.

At least some or all of the cylindrical filaments may have substantially end-rounded tips/free ends to provide gentle cleaning properties. End-rounded tips may avoid that gums get injured during brushing. Within the context of this disclosure, end-rounded filaments would still fall under the definition of a substantially cylindrical filament.

The at least one tuft comprising a plurality of said filaments has a longitudinal axis and a cross-sectional area which extends in a plane that is perpendicular to said longitudinal axis. The plurality of filaments is arranged in a manner that the cross-sectional area of the tuft has a scaled up shape of the respective shape of each individual filament which makes up the tuft. In other words, the tuft is a scaled up version of its filaments, i.e. the shape of the cross-sectional area of the tuft has substantially the same non-circular shape as each individual filament but in a larger size. The shape of the cross-sectional area of the tuft corresponds to the shape of the cross-sectional area of its filaments. In the context of this disclosure the term "cross-sectional area having a scaled up shape" means a cross-sectional area comprising the same shape but in increased size. Vice versa, the term "cross-sectional area having a scaled down shape" means a cross-sectional area comprising the same shape but in decreased size. In other words, the type of shape is the same but the size of the cross-sectional area is different, i.e. increased or decreased, respectively.

Any gaps, irregularities, reliefs or slots which may be present between two adjacent individual filaments at the outer circumference of the cross-sectional area of the tuft do not contribute to the substantial shape of said cross-sectional area and are, thus, to be neglected.

A head for an oral care implement comprising at least one of the tufts in accordance with the present disclosure may provide increased cleaning properties. The specific shape/geometry of the individual filaments has specific cleaning properties which may differ from the properties of regular filaments with a circular cross-sectional area. These specific cleaning properties may be enhanced by arranging the filaments in a manner so that they form a cross-sectional shape of the overall tuft which is a scaled up version of the cross-sectional shape of each individual filament. In addition, as the specific geometry of each single filament may be generally not visible to the user, the tuft in accordance with the present disclosure may communicate the respective geometry to the user and, thus, the corresponding cleaning properties of the filaments which make up said tuft.

As the filaments and the tuft, respectively, have each a cross-sectional area with a non-circular shape, the filaments as well as the overall tuft may provide anisotropic bending stiffness properties during a brushing process. In case a given contact pressure is applied to the free end of the filaments/tuft the amount of deflection/displacement of the filaments/tuft depends on the diameter/radius of the filaments/tuft. The smaller the diameter/radius, the higher is the deflection/displacement of the free end of the filaments/tuft, and vice versa, the larger the diameter/radius, the smaller is the deflection/displacement of the free end of the filaments/tuft. The tuft may be arranged on the mounting surface of the head in a manner that higher bending stiffness is provided in a direction where higher cleaning forces may be needed. Lower bending stiffness may be provided in a direction where gentle cleaning forces or a massaging effect may be required.

In some embodiments, the shape of the cross-sectional area of each filament may comprise at least one edge which may be arranged at the outer circumference of the cross-sectional area.

In some embodiments, the shape of the cross-sectional area of each filament may comprise at least one groove which may be arranged at the outer circumference of the cross-sectional area.

In some embodiments, the cross-sectional area of each filament may have the shape substantially of a square, rectangle, triangle, oval, cross, hexagon, rhomboid, clover-leaf, or semi-circle. Alternatively, the shape of the cross-sectional area of each filament may be substantially trilobal. Thus, the cross-sectional area of both, the tuft and its filaments may have such type of non-circular shape.

For example, filaments having a cross-sectional area substantially in the shape of a square, rectangle, triangle, cross, hexagon, rhomboid, clover-leaf or semi-circle, or filaments having a cross-sectional area being substantially trilobal may comprise at least two lateral edges at the outer lateral surface extending along the longitudinal extension of the filament. These lateral edges may be rounded or may be relatively sharp to facilitate removal of plaque and debris on the teeth's surface more efficiently. Further, these lateral edges may sweep plaque and debris away during a brushing process. These improved cleaning properties of such filaments may be further enhanced by a tuft having the respective scaled up shape. The at least two lateral edges extending along the longitudinal extension of the tuft may further facilitate removal of plaque and debris on the teeth's surface and may sweep plaque and debris away.

For example, filaments having a cross-sectional area substantially in the shape of a cross or clover-leaf, or filaments having a cross-sectional area being substantially trilobal may comprise grooves/open areas at their outer lateral surface along the filament extension. These grooves or open areas may facilitate that dentifrice retain at/adhere to the filaments for a longer period of time during a tooth brushing process and may avoid that the dentifrice spread away which may result in an improved overall brushing process. Further, the grooves may provide a capillary action which may enable the dentifrice to flow towards the tip/free end of the filament and, thus, may make the dentifrice available to the teeth and gums during brushing. The tuft having a corresponding cross-sectional shape may further facilitate such effects as the dentifrice may be retained/adhered in the respective grooves/open areas at the tuft's outer lateral surface.

Filaments having a cross-sectional area substantially in the shape of a square, rectangle or rhomboid may allow a relatively high packing factor of the filaments within the tuft as gaps between two adjacent filaments can be minimized In the context of this disclosure the term "packing factor" means the sum of all cross sectional areas of the filaments divided by the cross-sectional area of the overall tuft. Each of the filament types mentioned above comprises four straight sides/edges. Consequently, two adjacent filaments may face each other at their straight sides which may allow that the filaments are arranged in close proximity A high packing factor of filaments may provide improved brushing effectiveness, i.e. better removal of plaque and debris from the teeth's surface and gums. Further, tufts having a corresponding cross-sectional area in a scaled up shape may allow a relatively high packing factor of such tufts within a cluster of tufts. Thus, a relatively dense filament/bristle field pattern may be provided on the mounting surface of the head. The number of filaments and the number of tufts within a given area can be maximized to improve cleaning properties. Further, a relatively dense filament pattern, i.e. filaments being arranged in close proximity may provide a capillary action which may enable the dentifrice to flow towards the tip/free end of the filaments and, thus, may make the dentifrice more available to the teeth and gums during brushing.

Filaments having a cross-sectional area substantially in the shape of a rectangle or oval may provide distinct bending stiffness properties into different directions. A tuft comprising a correspondingly shaped cross-sectional area may further enhance such distinct bending stiffness properties.

In some embodiments, the at least one tuft may be arranged on the mounting surface in a manner, that higher bending stiffness is provided in a direction parallel to the longitudinal extension of the oral care implement and lower bending stiffness orthogonal thereto. This may provide gentle cleaning properties and a massaging effect when the head is moved from the teeth to the gums and vice versa, while the higher bending stiffness may provide higher forces to clean along the occlusal, buccal and lingual surfaces of the teeth.

In some embodiments, the filaments may be made of thermoplastic elastomer material (TPE), with or without an abrasive such as kaolin clay, polyamide, e.g. nylon, with or without an abrasive such as kaolin clay, polybutylene terephtalate (PBT) with or without an abrasive such as kaolin clay and/or of polyamide indicator material, e.g. nylon indicator material, colored at the outer surface. The coloring on the polyamide indicator material may be slowly worn away as the filament is used over time to indicate the extent to which the filament is worn.

In some embodiments, at least some of the filaments may comprise at least two segments of different materials. In some embodiments at least one segment may comprise a thermoplastic elastomer material (TPE) and at least one segment may comprise polyamide, e.g. nylon, with or without an abrasive such as kaolin clay, polybutylene terephtalate (PBT) with or without an abrasive such as kaolin clay or a polyamide indicator material, e.g. a nylon indicator material, colored at the outer surface. These at least two segments may be arranged in a side-by-side structure or in a core-sheath structure which may result in reduced stiffness of the overall filament. A core-sheath structure with an inner/core segment comprising a harder material, e.g. polyamide or PBT, and with an outer/sheath segment surrounding the core segment and comprising a softer material, e.g. TPE, may provide the filament with a relatively soft outer lateral surface which may result in gentle cleaning properties.

In some embodiments, at least some of the filaments may comprise a component selected from fluoride, zinc, strontium salts, flavor, silica, pyrophosphate, hydrogen peroxide, potassium nitrate or combinations thereof. For example, fluoride may provide a mineralization effect and, thus, may prevent tooth decay. Zinc may strengthen the immune system of the user. Hydrogen peroxide may bleach/whiten the teeth. Silica may have an abrasive effect to remove dental plaque and debris more effectively. Pyrophosphate may inhibit the formation of new plaque, tartar and dental calculus along the gum line. Filaments comprising pyrophosphate may offer lasting protection against inflammations of the gums and mucous membrane of the mouth.

In some embodiments, the tuft may comprise filaments arranged at the tuft's outer lateral surface which may comprise pyrophosphate to inhibit the formation of plaque, tartar and dental calculus along the gum line whereas filaments arranged in the center of the tuft may comprise fluoride to mineralize the teeth during a brushing process.

In some embodiments, at least one of the components listed above may be coated onto a core, i.e. onto a inner/core segment of a filament. In other words, at least some of the filaments of the tuft may comprise a core-sheath structure wherein the inner/core segment may comprise TPE, polyamide or PBT and the outer/sheath segment may comprise at least one of the components listed above. Such core-sheath structure may make the component(s) directly available to the teeth in a relatively high concentration, i.e. the component(s) may be in direct contact with the teeth during brushing.

Alternatively, at least one of the components listed above may be co-extruded with TPE, polyamide, e.g. nylon, and/or PBT. Such embodiments may make the component(s) gradually available to the teeth when the filament material is slowly worn away during use.

In some embodiments, the head may comprise a plurality of tufts forming a cluster of tufts. The cluster of tufts has a longitudinal axis and a cross-sectional area extending in a plane that is perpendicular to the longitudinal axis. The plurality of tufts may be arranged in a manner that the cross-sectional area of the cluster of tufts has a scaled up shape with respect to the shape of the cross-sectional area of each tuft. Such cluster of tufts may provide a head for an oral care implement with further enhanced specific cleaning properties of the individual tufts forming said cluster. Further, such cluster of tufts may communicate the respective geometry and, thus, the corresponding cleaning properties of the filaments forming the individual tufts.

In some embodiments, the at least one tuft may be attached/secured to the head by means of a hot tufting process. One method of manufacturing the head of an oral care implement may comprise the following steps: Firstly, the at least one tuft may be formed by providing a desired amount of filaments. Secondly, the tuft may be placed into a mold cavity so that ends of the filaments which are supposed to be attached to the head extend into said cavity. Thirdly, the head or an oral care implement body comprising the head and the handle may be formed around the ends of the filaments extending into the mold cavity by an injection molding process, thereby anchoring the at least one tuft in the head. Alternatively, the tuft may be anchored by forming a first part of the head—a so called "sealplate"—around the ends of the filaments extending into the mold cavity by an injection molding process before the remaining part of the oral care implement may be formed. Before starting the injection molding process, the ends of the at least one tuft extending into the mold cavity may be optionally melted or fusion-bonded to join the filaments together in a fused mass or ball so that the fused masses or balls are located within the cavity. The at least one tuft may be held in the mold cavity by a mold bar having blind holes that correspond to the desired position of the tuft on the finished head of the oral care implement. In other words, the filaments of the at least one tuft attached to the head by means of a hot tufting process may be not doubled over a middle portion along their length and may be not mounted in the head by using an anchor/staple. The at least one tuft may be mounted on the head by means of an anchor-free tufting process.

The oral care implement may be a toothbrush comprising a handle and a head according to any of the embodiments described above. The head extends from the handle and may be either repeatedly attachable to and detachable from the handle or the head may be non-detachably connected to the handle. The toothbrush may be an electrical or a manual toothbrush.

The following is a non-limiting discussion of example embodiments of oral care implements and parts thereof in accordance with the present disclosure, where reference to the Figures is made.

FIG. 1 shows a perspective top-down view of a first embodiment of an oral care implement 10 which could be a manual or an electrical toothbrush 10 comprising a handle 12 and a head 14 extending from the handle 12 in a longitudinal direction. The head 14 has a proximal end 41 close to the handle 12 and a distal end 40 furthest away from the handle 12, i.e. opposite the proximal end 41. The head 14 may have substantially the shape of an oval with a length extension 52 and a width extension 51 substantially perpendicular to the length extension 52. A plurality of tufts 16 in accordance with the present disclosure may be secured to the head 14 by means of a hot tufting process. The tufts 16 may extend from a mounting surface 18 of the head 14 in a substantially orthogonal manner.

Figure 2:
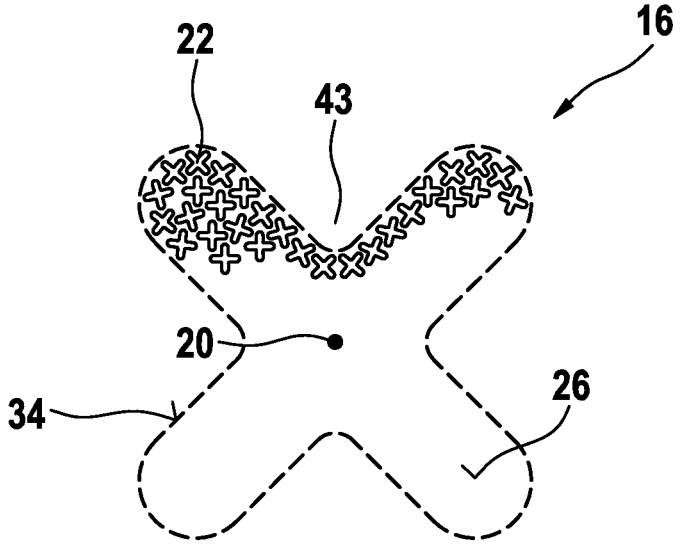
FIG. 2 shows a schematic top-down view of a first example embodiment of a tuft shown in FIG. 1.
Figure 3:
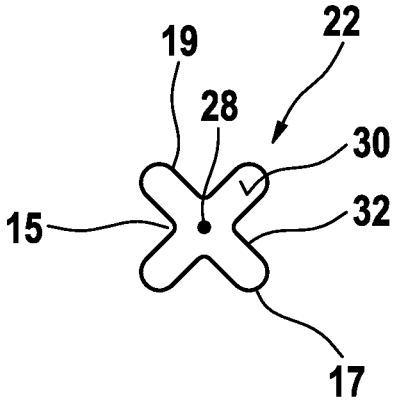
FIG. 3 shows a schematic top-down view of a first example embodiment of a filament shown in FIG. 2.
Figure 4:
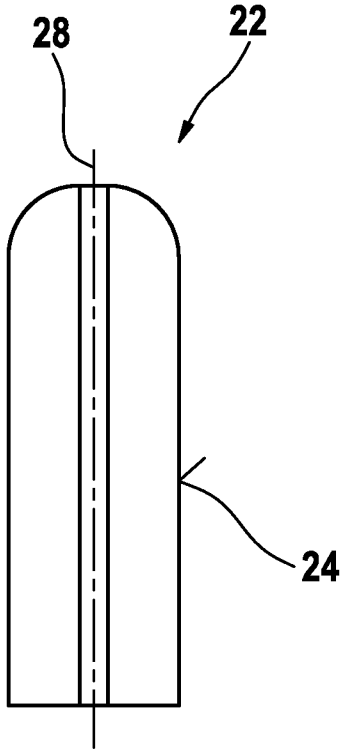
FIG. 4 shows a schematic side view of the filament of FIG. 3.

The tuft 16 as illustrated in FIG. 2 comprises a plurality of end-rounded cylindrical filaments 22, one of them being shown in FIGS. 3 and 4. Each filament 22 has a longitudinal axis 28 and a cross-sectional area 30 extending in a plane that is perpendicular to the longitudinal axis 28. The cross-sectional area 30 may have a shape 32 substantially of a cross, i.e. the shape 32 of said cross-sectional area 30 is non-circular. The cross-shaped cross-sectional area 30 of the filament 22 has an outer circumference 19 comprising four edges 17 and four grooves 15 which are arranged in an alternating manner. In other words, each filament 22 of the tuft 16 has an outer lateral surface 24 with a non-circular cylindrical shape. The plurality of filaments 22 is arranged in a manner that the tuft 16 has a cross-sectional area 26 which extends in a plane perpendicular to the tuft's longitudinal axis 20 having a scaled up shape of the shape of each individual filament 22. The shape of the cross-sectional area 26 of the tuft 16 corresponds to the shape of the cross-sectional area 30 of each individual filament 22. In other words, the tuft 16 has an outer lateral surface 34 in a shape which is substantially the shape of the outer lateral surface 24 of each individual filament 22. Such tuft 16 may be hereinafter referred to as "cross-shaped tuft 16".

The oral care implement 10 shown in FIG. 1 may comprise one row 38 of two cross-shaped tufts 16 being arranged in the central portion of the mounting surface 18 along the length extension 52 of the head 14. However, the row 38 may also comprise more than two cross-shaped tufts 16 or the head 14 may even be provided with more than one row of cross-shaped tufts 16. Further tufts 42 with a triangle-shaped cross-sectional area may be arranged in the open areas/grooves 43 of the cross-shaped tufts 16. The filaments of tufts 42 may have a circular-or a triangle-shaped cross-sectional area. In addition, a further tuft 44 with a rhomboid-shaped cross-sectional area may be arranged in the two opposing open areas/grooves 43 of the two tufts 16. The filaments of tuft 44 may have a circular-or a rhomboid-shaped cross-sectional area.

Figure 5:
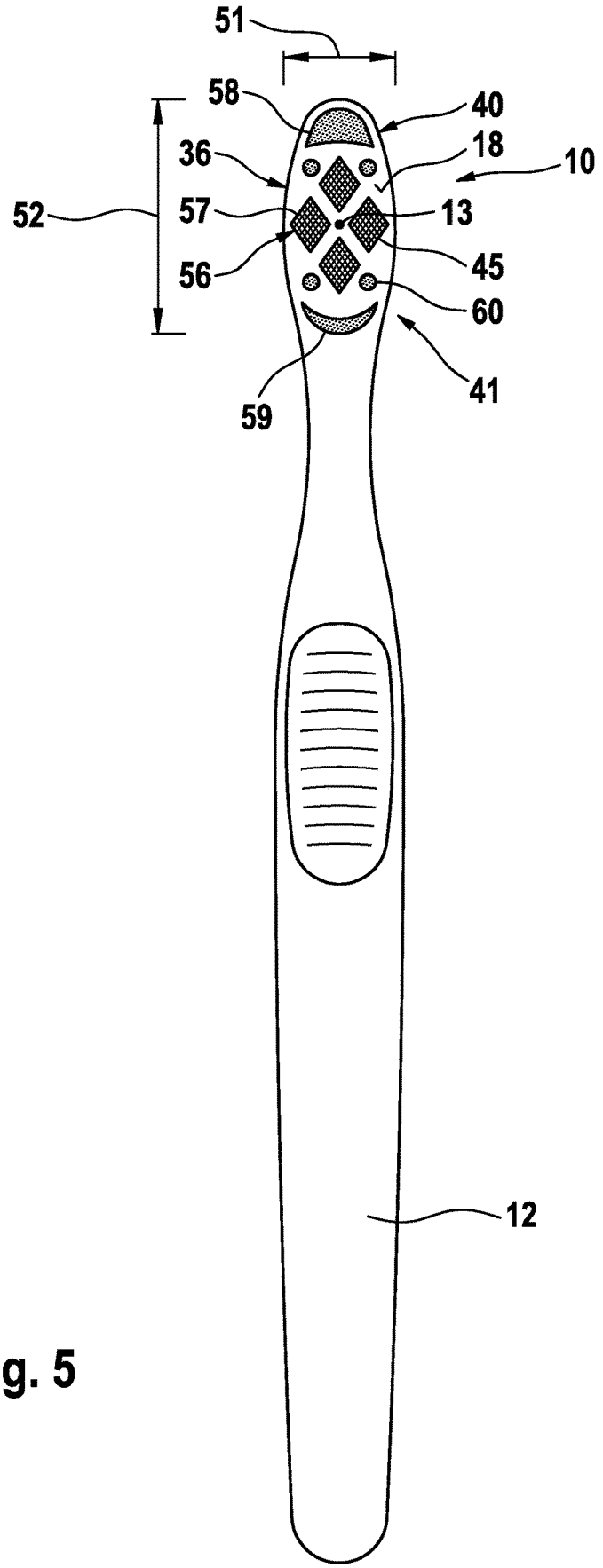
FIG. 5 shows a schematic top-down view of a second example embodiment of an oral care implement comprising a second example embodiment of a head.
Figure 6:
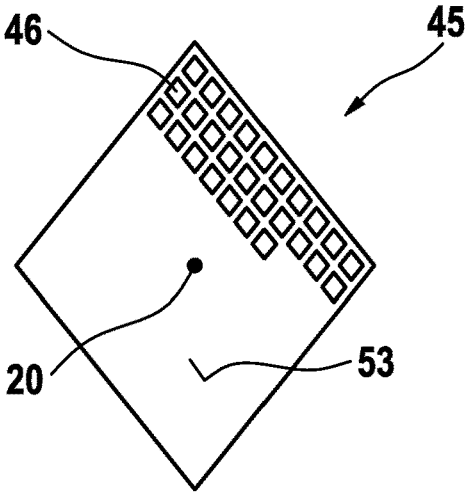
FIG. 6 shows a schematic top-down view of a second example embodiment of a tuft shown in FIG. 5.
Figure 7:
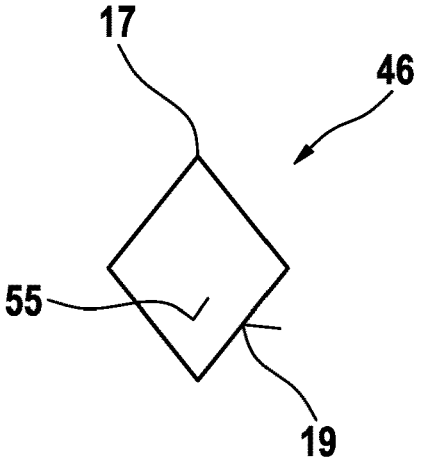
FIG. 7 shows a schematic top-down view of a second example embodiment of a filament shown in FIG. 6.

FIG. 5 shows a perspective top-down view of a second embodiment of an oral care implement 10 which is similar to that shown in FIG. 1. However, the head 36 may comprise a plurality of tufts 45 wherein each tuft 45 has a cross-sectional area 53 in the shape substantially of a rhomboid. Such tuft 45 may be hereinafter referred to as "rhomboid-shaped tuft 45". The rhomboid-shaped tufts 45, one of them being illustrated in FIG. 6, may be composed of filaments 46 each having a scaled down rhomboid-shaped cross-sectional area 55 (cf. FIG. 7). The plurality of rhomboid-shaped tufts 45 may form a cluster 56 of tufts 45. The cluster 56 may have a correspondingly-shaped cross-sectional area 57 extending in a plane that is perpendicular to the longitudinal axis 13 of the cluster 56. In other words, the plurality of rhomboid-shaped tufts 45 is arranged in a manner that the cross-sectional area 57 of the cluster 56 has a scaled up rhomboid shape. In the toe region at the distal end 40 of the head 36, one semi-circle-shaped tuft 58 may be attached to the head 36. At the opposite side, i.e. at the proximal end 41 of the head 36 one crescent-shaped tuft 59 may be attached. Further, on every straight side of the rhomboid-shaped cluster 56 there may be one substantially circle-shaped tuft 60 secured to the head 36.

FIGS. 8 to 16 show further tuft embodiments 71, 72, 73, 74, 75, 76, 77, 78, 79 having a non-circular cross-sectional area 80, 82, 85, 86, 88, 90, 92, 94, 96 which extends in a plane that is perpendicular to the longitudinal axis 20 of the respective tuft 71, 72, 73, 74, 75, 76, 77, 78, 79.

Figure 8:
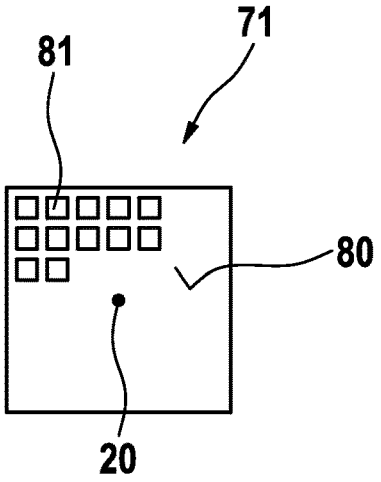
FIG. 8 shows a schematic top-down view of a third example embodiment of a tuft.

Tuft 71 as shown in FIG. 8 may have a cross-sectional area 80 in the shape substantially of a square. Such tuft 71 is composed of filaments 81 having a corresponding cross-sectional area with a scaled down shape, i.e. the shape of each filament 81 corresponds to the shape of the tuft 71.

Figure 9:
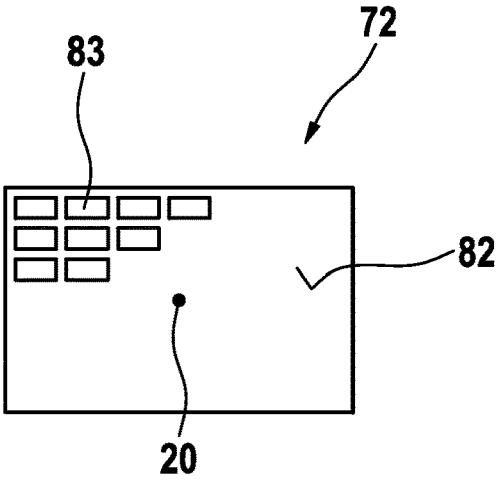
FIG. 9 shows a schematic top-down view of a fourth example embodiment of a tuft.

Tuft 72 as shown in FIG. 9 may have a cross-sectional area 82 in the shape substantially of a rectangle. Such tuft 72 is composed of filaments 83 having a corresponding cross-sectional area with a scaled down shape, i.e. the shape of each filament 83 corresponds to the shape of the tuft 72.

Figure 10:
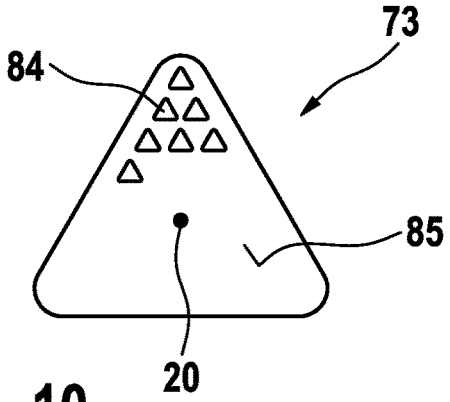
FIG. 10 shows a schematic top-down view of a fifth example embodiment of a tuft.

Tuft 73 as shown in FIG. 10 may have a cross-sectional area 85 in the shape substantially of a triangle. Such tuft 73 is composed of filaments 84 having a corresponding cross-sectional area with a scaled down shape, i.e. the shape of each filament 84 corresponds to the shape of the tuft 73.

Figure 17:
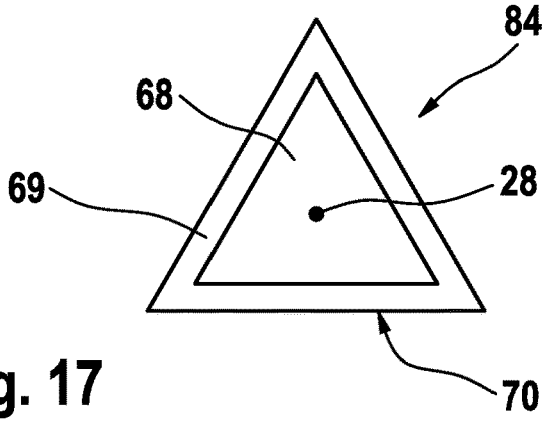
FIG. 17 shows a schematic top-down view of a filament shown in FIG. 10.

As shown in FIG. 17, at least some of the triangle-shaped filament 84 may comprise at least two segments 68, 69 of different materials, for example a core-sheath structure 70. The core-or inner-segment 68 may comprise polyamide or polybutylene terephtalate whereas the sheath-or outer-segment 69 may comprise a thermoplastic elastomer which may be co-extruded with a component selected from fluoride, zinc, strontium salts, flavor, silica, pyrophosphate, hydrogen peroxide, potassium nitrate or combinations thereof. Although the core-sheath structure 70 is illustrated by means of a triangle-shaped tuft, other non-circular shaped filaments in accordance with this disclosure may also comprise at least two segments of different materials as outlined above.

Figure 11:
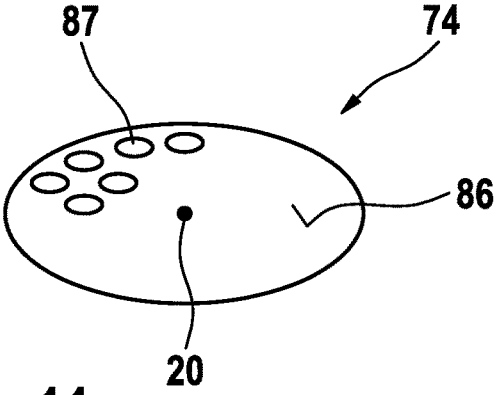
FIG. 11 shows a schematic top-down view of a sixth example embodiment of a tuft.

Tuft 74 as shown in FIG. 11 may have a cross-sectional area 86 in the shape substantially of an oval. Such tuft 74 is composed of filaments 87 having a corresponding cross-sectional area with a scaled down shape, i.e. the shape of each filament 87 corresponds to the shape of the tuft 74.

Figure 12:
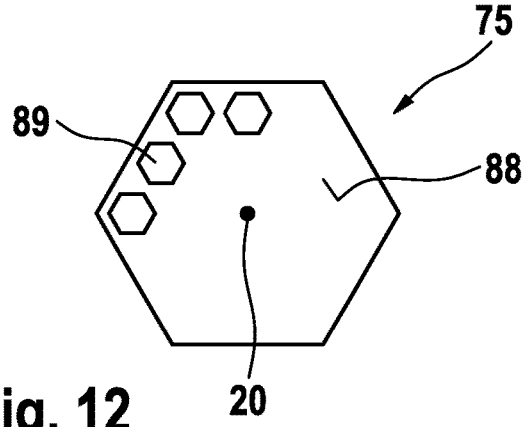
FIG. 12 shows a schematic top-down view of a seventh example embodiment of a tuft.

Tuft 75 as shown in FIG. 12 may have a cross-sectional area 88 in the shape substantially of a hexagon. Such tuft 75 is composed of filaments 89 having a corresponding cross-sectional area with a scaled down shape, i.e. the shape of each filament 89 corresponds to the shape of the tuft 75.

Figure 13:
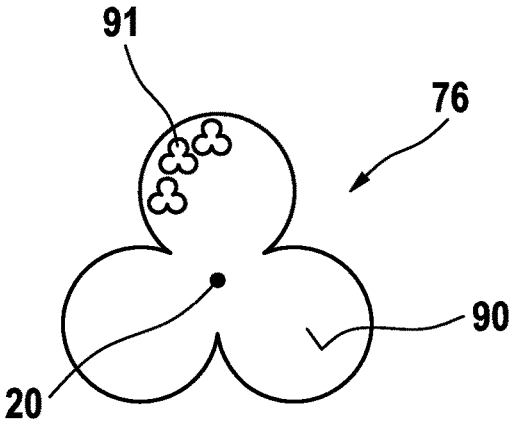
FIG. 13 shows a schematic top-down view of an eights example embodiment of a tuft.

Tuft 76 as shown in FIG. 13 may have a cross-sectional area 90 in the shape substantially of a three-finger clover-leaf. Such tuft 76 is composed of filaments 91 having a corresponding cross-sectional area with a scaled down shape, i.e. the shape of each filament 91 corresponds to the shape of the tuft 76.

Figure 14:
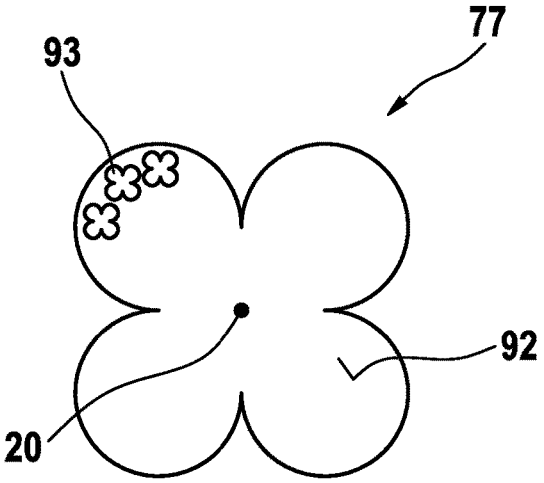
FIG. 14 shows a schematic top-down view of a ninth example embodiment of a tuft.

Tuft 77 as shown in FIG. 14 may have a cross-sectional area 92 in the shape substantially of a four-finger clover-leaf. Such tuft 77 is composed of filaments 93 having a corresponding cross-sectional area with a scaled down shape, i.e. the shape of each filament 93 corresponds to the shape of the tuft 77.

Figure 15:
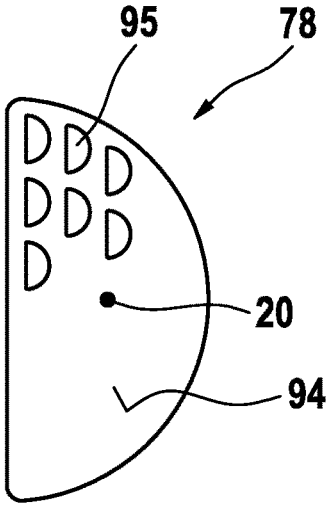
FIG. 15 shows a schematic top-down view of a tenth example embodiment of a tuft.

Tuft 78 as shown in FIG. 15 may have a cross-sectional area 94 in the shape substantially of a semi-circle. Such tuft 78 is composed of filaments 95 having a corresponding cross-sectional area with a scaled down shape, i.e. the shape of each filament 95 corresponds to the shape of the tuft 78.

Figure 16:
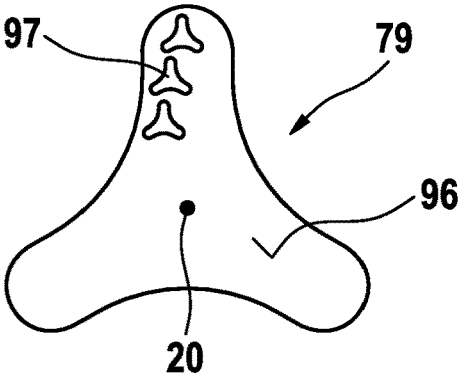
FIG. 16 shows a schematic top-down view of an eleventh example embodiment of a tuft.

Tuft 79 as shown in FIG. 16 may have a cross-sectional area 96 which is substantially trilobal. Such tuft 79 is composed of filaments 97 having a corresponding cross-sectional area with a scaled down shape, i.e. the shape of each filament 97 corresponds to the shape of the tuft 79.

In the context of this disclosure, the term "substantially" refers to an arrangement of elements or features that, while in theory would be expected to exhibit exact correspondence or behavior, may, in practice embody something slightly less than exact. As such, the term denotes the degree by which a quantitative value, measurement or other related representation may vary from a stated reference without resulting in a change in the basic function of the subject matter at issue.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm "

What is claimed is:

1. A head for an oral care implement comprising:

a mounting surface, and at least one cross-shaped tuft mounted on the mounting surface, the at least one cross-shaped tuft having a tuft longitudinal axis and a cross-shaped cross-sectional area extending in a plane perpendicular to the tuft longitudinal axis, the at least one cross-shaped tuft comprising a plurality of cross-shaped filaments, each having a filament longitudinal axis and a cross-shaped cross-sectional area extending in a plane perpendicular to the filament longitudinal axis, wherein the cross-sectional area of the at least one cross-shaped tuft has a scaled-up shape of the cross-sectional area of each of the plurality of cross-shaped filaments comprising the at least one cross-shaped tuft.

2. A head according to claim 1, wherein the shape of the cross-sectional area of at least some of the filaments comprises at least one groove.

3. A head according to claim 1, wherein the shape of the cross-sectional area of at least some of the filaments comprises at least one edge.

4. A head according to claim 1, wherein at least some of the filaments comprise at least two segments of different materials.

5. A head according to claim 4, wherein at least one of the at least two segments comprises a thermoplastic elastomer.

6. A head according to claim 1, wherein at least some of the filaments have a structure comprising a core and a sheath.

7. A head according to claim 6, wherein the sheath comprises a thermoplastic elastomer.

8. A head according to claim 1, wherein at least some of the filaments comprise a component selected from the group consisting of fluoride, zinc, strontium salts, flavor, silica, pyrophosphate, hydrogen peroxide, potassium nitrate, and any combination thereof.

9. A head according to claim 8, wherein the component is coated onto a core of the filament.

10. A head according to claim 8, wherein the component is co-extruded with a thermoplastic elastomer material, polyamide, or polybutylene terephthalate.

11. A head according to claim 1, wherein the at least one tuft is attached to the head by hot tufting.

12. An oral-care implement comprising a head, wherein the head comprises:

a mounting surface, and at least one cross-shaped tuft mounted on the mounting surface, the at least one cross-shaped tuft having a tuft longitudinal axis and a cross-shaped cross-sectional area extending in a plane perpendicular to the tuft longitudinal axis, the at least one cross-shaped tuft comprising a plurality of cross-shaped filaments, each having a filament longitudinal axis and a cross-shaped cross-sectional area extending in a plane perpendicular to the filament longitudinal axis, wherein the cross-sectional area of the at least one cross-shaped tuft has a scaled-up shape of the cross-sectional area of each of the plurality of cross-shaped filaments comprising the at least one cross-shaped tuft.

* * * * *